United States Patent [19]

Stone et al.

[11] Patent Number: 4,519,631

[45] Date of Patent: May 28, 1985

[54] SYSTEM FOR PROVIDING UPDATED PRODUCT AND PRICING INFORMATION FOR RETAILER

[76] Inventors: Joel R. Stone; Gary H. Stone, both of 2141 Upper St. Dennis, both of St. Paul, Minn. 55116

[21] Appl. No.: 455,918

[22] Filed: Jan. 6, 1983

[51] Int. Cl.[3] ..... B42D 15/00

[52] U.S. Cl. ..... 283/70; 283/81; 283/79

[58] Field of Search ..... 283/70, 79, 80, 81, 283/101

[56] References Cited

U.S. PATENT DOCUMENTS

| | | | |
|---|---|---|---|
| 3,946,507 | 3/1976 | Fergg et al. | 40/2 R |
| 4,028,824 | 6/1977 | Miller | 283/81 X |
| 4,110,502 | 8/1978 | Baer | 283/101 X |
| 4,260,656 | 4/1981 | Mullen | 283/81 X |
| 4,329,191 | 5/1982 | Barber | 283/81 X |

*Primary Examiner*—Paul A. Bell

*Attorney, Agent, or Firm*—Jacobson and Johnson

[57] ABSTRACT

One section of a two piece label is marked by the supplier (wholesaler) with general product information and a separable section of the same label is marked with certain pricing information for the consumer and the label is then attached to the product's shipping container in a fashion such that the general product information remains permanently attached to the container and the consumer pricing information section can be removed and placed on the store shelf when the product is removed from the container and placed on the shelf.

3 Claims, 2 Drawing Figures

SYSTEM FOR PROVIDING UPDATED PRODUCT AND PRICING INFORMATION FOR RETAILER

BACKGROUND OF THE INVENTION

The invention will be described as it would be utilized in the grocery business but it is equally applicable to other similar business operations in which a wholesaler or supplier provides products which are eventually placed on shelves for display to and purchased by consumers.

In the grocery business a wholesaler or supplier (hereinafter supplier) usually has stored in its warehouse facilities cases of various products. These products are located and arranged in a fashion such that they can be readily located and removed in response to orders received from a retailer. Upon receipt of an order a case or carton of the product (or some suitable type of shipping container with enclosed product) is removed from its location in the warehouse and prior to shipment to the retailer a label or tag called a "picking sticker" is attached to the shipping case. Before attaching the "picking sticker" the supplier inserts various indicia on the label which, among other things, identifies the product contained in the shipping case and pricing information. Typically included in this indicia is a description of the product, the number of units, the size of each unit, unit price, customer's name and address, the corresponding invoice number, etc. Further, as a result of recent mechanization and automation of the processing of grocery supplies and the utilization of computers, code pricing information in bar code fashion which can be recognized by a suitable code reader is placed on the label. It is important that this label be attached to the shipping case so that it does not easily peel or fall off. Not only does the label conveniently continue to identify the product when the retailer received it, but also when the retailer wants to put the product on the store shelf he will then read off the unit price code from the label into his computer so that it becomes available at the checkout counters when the product is purchased. From the supplier's viewpoint, it is important that the "picking sticker" remains permanently attached so that there can be no claim later that the wrong goods or wrong quantities were delivered.

When the shipping case of product is removed from the retailer's temporary storage area for placement on the shelf for display and for sale to the consumer, it is necessary to identify to the consumer the price of the product. In many instances the practice has been to place a small sticker with the price on each individual container as it is removed from the shipping case and placed on the shelf. Other times the price may be stamped on the product or on its container. A number of difficulties arise using these methods. For one, the prices usually change quite often so some of the older products on the store shelf are marked with one price and the newer products are marked with a different price. Also, the clerk or shelf filler often is in a hurry and so overlooks or forgets to mark the price of the product.

With the advent of automation, many products are received by the retailer individually marked with the price bar code so there is less need for the retailer to mark each individual article. But the retailer must still provide intelligible pricing information for the purchaser. This is usually done by placing a marker on the store shelf containing pricing information such as unit price and total price. In some areas local governments have passed ordinances making it mandatory that this, and sometimes additional, pricing information be accurately and clearly displayed on the store shelves for the benefit of the consumer. This means that each time the price, the product or the product size is changed, the shelf marker must also be changed. This usually happens each time the shelves are restocked by new or additional product being brought from storage and placed on the shelf. Oftentimes the shelf filler overlooks or forgets to make out a new shelf marker in his eagerness to get the shelf restocked with product.

SUMMARY OF THE INVENTION

According to the teachings of this invention the supplier attaches a two piece marking tag or label or "picking sticker" on his shipping container. On one section of the tag the supplier inserts the indicia necessary to generally identify the contents of the shipping container such as the description of the product, the number of units, the unit price in bar code form, name and address of the customer, etc. On the other separable part of the label the supplier provides the necessary pricing information for the retailer to display on his shelf marker. The first section of the label is fixedly adhered to the shipping case but the removable section can be peeled off when the shipping case of product is brought into the store for the product to be removed and placed on the shelf. At that time the removable section of the label is peeled off and placed on the shelf marker. In this fashion there is automatic up-dating of the pricing information to be placed on the shelf marker as new product is placed on the shelf.

DESCRIPTION OF THE PREFERRED EMBODIMENT

Figure 1:
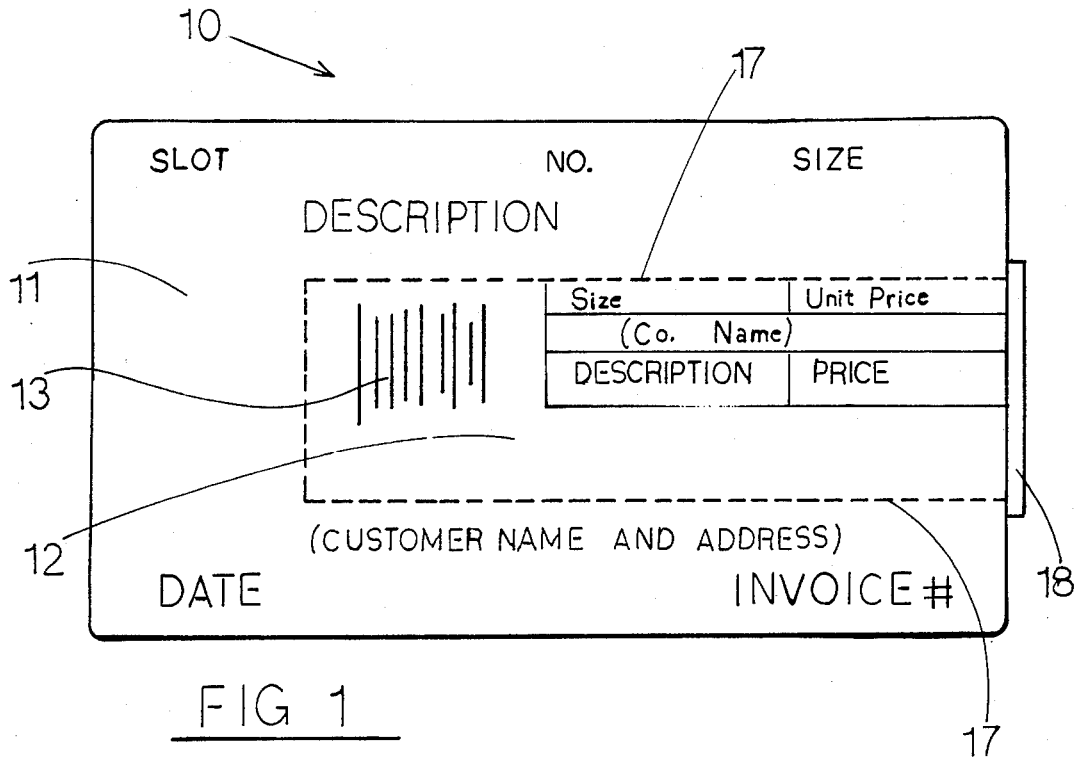
FIG. 1 is an illustration of a two section label utilized in the instant invention.

As mentioned earlier, when a quantity of product is ordered by the retailer from the supplier, the supplier locates a case of the product in his inventory or fills a shipping case with the ordered product. As part of his own inventory control and to provide the customer (the retailer) necessary information for his inventory control and pricing, the supplier places various indicia or markings on a label 10 which is then attached to the shipping case. Typically, (no limitation thereto being intended) as illustrated in FIG. 1, this indicia in one section 11 of the label may include the size and number of unit product in the shipping case, a description of the product, the customer's name and address, the date of shipment and an invoice number. On an inner separable section 12 of the label 10, defined by score or tear line 17, the supplier inserts further pricing information for the benefit of the retailer. Typically, as illustrated in FIG. 1, the information may be the unit size of the product, the unit price (price per ounce or pint, etc.), the total price and a description of the product. Also, for use with modern day computerized systems, there would be included the price of the product in the form of a bar code 13 which is later scanned by a suitable electronic reader for automatic read-out.

Figure 2:
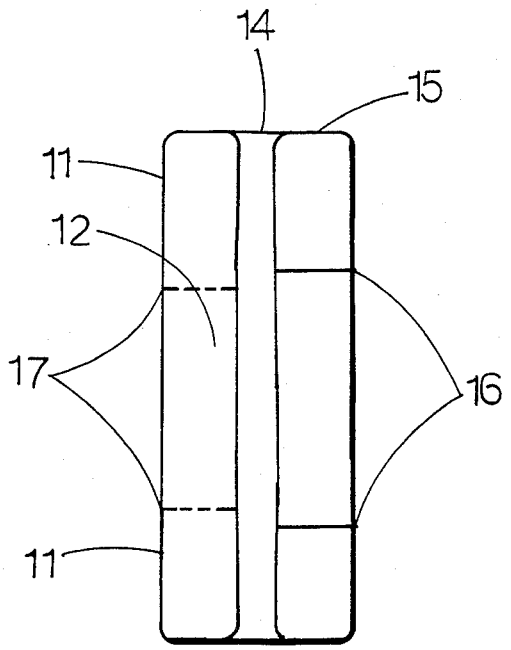
FIG. 2 is an end view of the label illustrated in FIG. 1.

The information is placed on the label when the label is in the form as illustrated in FIG. 2. The backs of the first section 11 containing the general information and the separable section 12 are coated with a layer of adhesive 14 which in turn is covered with a backing layer 15 which is generally a waxed paper which can be readily stripped off. The backing layer 15 is scored or has a tear line 16 to define an area generally equal to the area of the separable section 12. After the information is placed on the label the backing layer 15 is stripped off along score or tear line 16 exposing the adhesive layer 14 on the back of section 11 of label 10 and the label is then placed on the shipping container or carton and held there by the adhesive. Because the backing layer still remains behind the separable section 12, it does not firmly adhere to the container yet is held in place by its scored or tear line attachment to section 11.

When the retailer receives the goods they generally are stored at least temporarily in a suitable storage area. When the goods are ready to be placed on the shelf the clerk takes the shipping container to the shelf area, opens the container and removes the product and places the individual units on the shelf. At that time then he strips off the separable section 12 of label 10 along score line 17 and places the separable section containing the pricing information on the shelf edge or on a suitable shelf marker. In most cases the backing is left on the separated section 12 so that it does not adhere to the shelf marker and can be slipped out and replaced with a new label when necessary. In some instances, however, the retailer might want the label adhesively attached to the shelf. This is easily accomplished by merely stripping off the backing layer and sticking the label on the shelf.

The backing layer area defined by score line 16 may be slightly greater than the area of section 12 of the label to ensure that the latter does not stick to the shipping case. The overlap of section 11 should be so slight that it does not prevent section 12 with its attached backing layer from being easily stripped away when necessary. Also, a slight extension of the backing layer 15 to form tab 18 will make it easier to strip off section 12 when it is to be placed in the shelf marker. Alternately, the label can be made without adhesive on the back of the separable section 12. In that case, the waxed paper backing for section 12 would not be needed.

We claim:

1. A method for providing product information and consumer pricing information on goods shipped by a supplier to a retailer for retail sale from store shelves, comprising the steps of:

the supplier placing computer generated retailer product information indicia on the face of a first section of a paper label, said product information including identification of the product, number of units of product, unit price and address of retailer;

the supplier also placing consumer intelligible pricing indicia on the face of an attached but separable section of said label;

the supplier attaching said marked label to a shipping container in which products are shipped by the supplier to the retailer with only the first section of said label fixedly attached to the shipping container; and then the retailer detaching the separable label section from the first section of the label and placing the separated section on the display shelf for providing intelligible pricing information for the consumer when the retailer removes the products from the shipping container and places them on a display shelf for sale to the consumer.

2. The method as described in claim 1 wherein the supplier adhesively attaches the label to the shipping container.

3. The method as described in claim 1 wherein the retailer detaches the separable label section by tearing it free along at least one scored tear-line.

* * * * *